US005908486A

United States Patent [19]

Flinn et al.

[11] Patent Number: 5,908,486

[45] Date of Patent: Jun. 1, 1999

[54] STRENGTHENING OF METALLIC ALLOYS WITH NANOMETER-SIZE OXIDE DISPERSIONS

[75] Inventors: John E. Flinn, Idaho Falls, Id.; Thomas F. Kelly, Madison, Wis.

[73] Assignee: Lockheed Martin Idaho Technologies Company, Idaho Falls, Id.

[21] Appl. No.: 08/638,080

[22] Filed: Apr. 26, 1996

[51] Int. Cl.[6] ..... C22C 38/00; C22C 19/03

[52] U.S. Cl. ..... 75/232; 75/246; 75/352; 75/355; 75/252; 148/207; 148/513; 148/514

[58] Field of Search ..... 75/232, 246, 352, 75/355, 252; 148/207, 513, 514

[56] References Cited

U.S. PATENT DOCUMENTS

| | | | |
|---|---|---|---|
| 3,615,381 | 10/1971 | Hammond et al. . | |
| 3,620,690 | 11/1971 | Bergstrom | 29/182 |
| 3,776,704 | 12/1973 | Benjamin . | |
| 4,240,831 | 12/1980 | Ro et al. | 75/228 |
| 4,340,432 | 7/1982 | Hede et al. | 148/11.5 |
| 4,487,744 | 12/1984 | DeBold et al. | 420/584 |
| 4,770,703 | 9/1988 | Tarutani et al. | 75/246 |
| 4,832,765 | 5/1989 | DeBold et al. | 148/325 |
| 5,571,304 | 11/1996 | Ritter et al. | 75/246 |

OTHER PUBLICATIONS

K.J. Irvine et al., "High–Strength Austenitic Stainless Steels," *Journal of the Iron and Steel Institute,* Oct. 1961, pp. 153–175.

L.A. Norstrom, "The Influence of Nitrogen and Grain Size on Yield Strength in Type AISI 316L Austenitic Stainless Steel," *Metal Science,* Jun. 1977, pp. 208–212.

C.R. Brinkman et al., "Long–Term Creep and Creep–Rupture Behavior of Types 304 and 316 Stainless Steel, Type 316 Casting Material (CF8M), and 2 ¼ Ce–1 Mo Steel—A Final Report," Oak Ridge Natinoal Laboratory, Jun. 1986.

K. Nakata et al., "Void Formation and Precipitation During Electron–Irradiation in Austenitic Stainless Steels Modified with Ti, Zr and V," *Journal of Nuclear Materials,* 148 (1987) pp. 185–193.

High Nitrogen Steels, Proceedings of the International Conference organized by The Institute of Metals and the Societe Francaise de Metallurgie, held at Lille, France on May 18–20, the Instutute of Metals, 1989, J. Foct and A. Hendry, Editors.

High Nitrogen Steels, 2nd Internatinal Conference organized by Ministerium fur Wirtshaft, Mittelstand und Technologie des Landes Nordrhein–Westfalen, Verein Deutscher Eisenhuettenleute, and Deutsche Gesellschaft fur Metallkunde e.V., held at Aachen, Germany, Oct. 10–12, 1990. G. Stein and H. Witulski, Editors.

H.L. Eiselstein et al., "The Invention and Definition of Alloy 625," Superalloys 718, 625 and Various Derivatives, E. A. Loria, Ed., The Minerals, Metals & Materials Society, 1991.

R.B. Frank, "Custom Age 625 Plus Alloy—A Higher Strength Alternative to Alloy 625," Superalloys 718, 625 and Various Derivatives,, E.A. Loria, Ed., The Minerals, Metals & Materials Society, 1991.

*Primary Examiner*—Ngoclan Mai

*Attorney, Agent, or Firm*—Armstrong Westerman Hattori McLeland & Naughton

[57] ABSTRACT

Austenitic stainless steels and nickel-base alloys containing, by wt. %, 0.1 to 3.0% V, 0.01 to 0.08% C, 0.01 to 0.5% N, 0.05% max. each of Al and Ti, and 0.005 to 0.10% O, are strengthened and ductility retained by atomization of a metal melt under cover of an inert gas with added oxygen to form approximately 8 nanometer-size hollow oxides within the alloy grains and, when the alloy is aged, strengthened by precipitation of carbides and nitrides nucleated by the hollow oxides. Added strengthening is achieved by nitrogen solid solution strengthening and by the effect of solid oxides precipitated along and pinning grain boundaries to provide temperature-stabilization and refinement of the alloy grains.

34 Claims, 12 Drawing Sheets

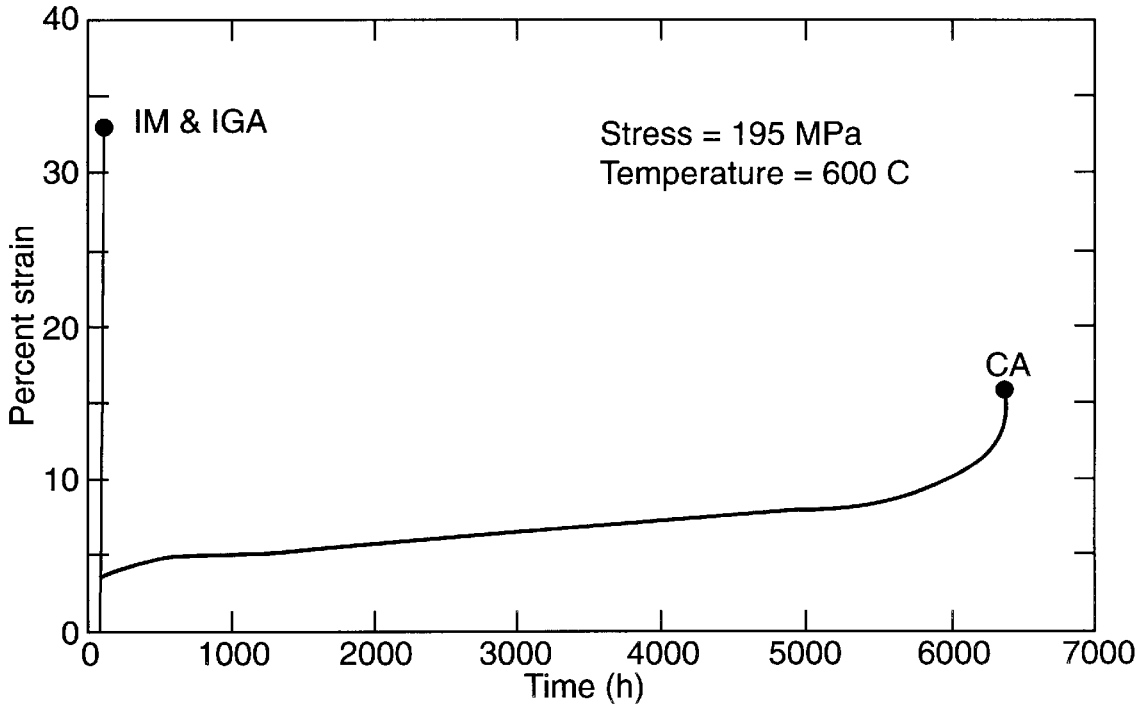
Figure 1. Creep strenthening of 304 SS by introducing nanometer -size hollow oxides (CA material) during RSP.

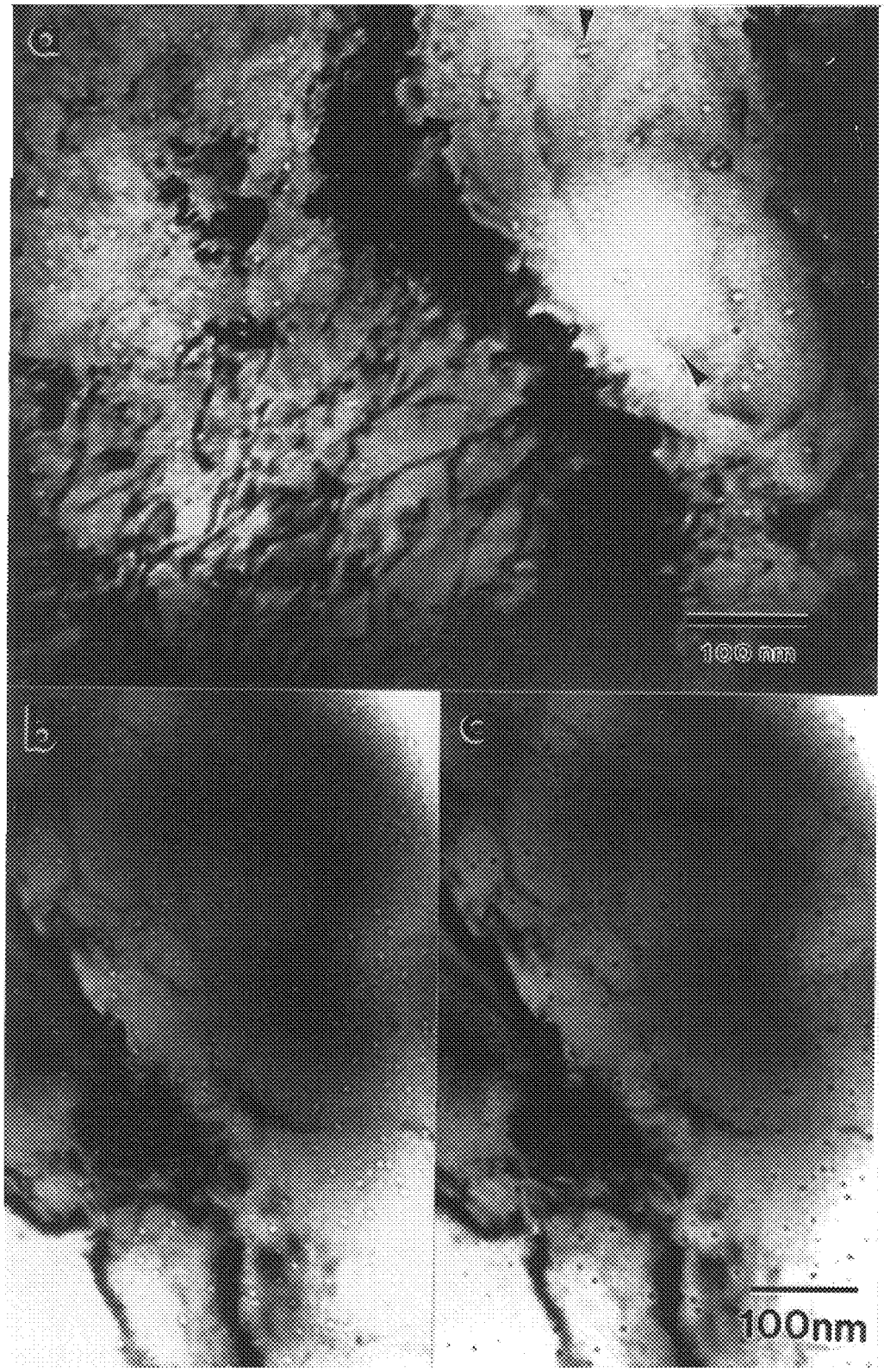
Figure 2. 8 nm cavities in CA Type 304 SS extruded powder: (a) 900°, bright-field underfocus, bright-field underfocus, and (c) 1200oC, bright-field overfocus images. The arrows in (a) indicate cavities that are equally spaced along a smooth curve.

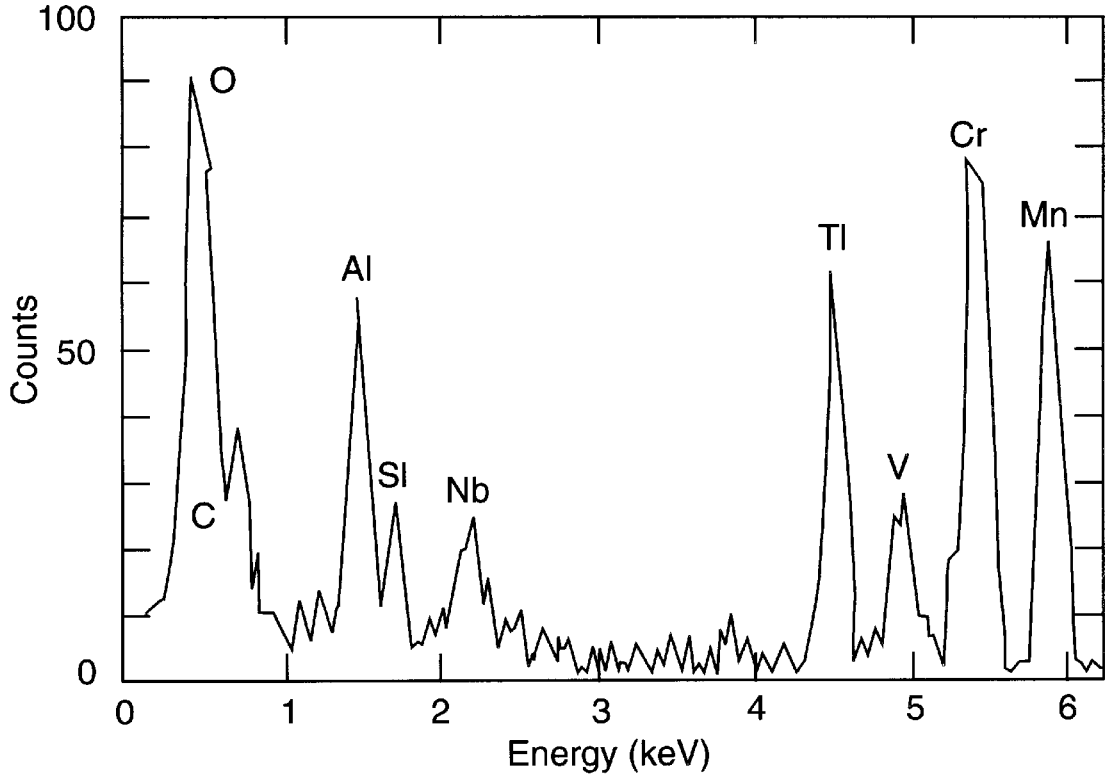
Figure 3. X-ray spectrum from 8 nm cavities in CA Type 304 SS extruded powderafter 900° C for 1 hour. This figure is obtained by subtracting a normalized spectrum of the surrounding matrix from the spectrum of the cavity.

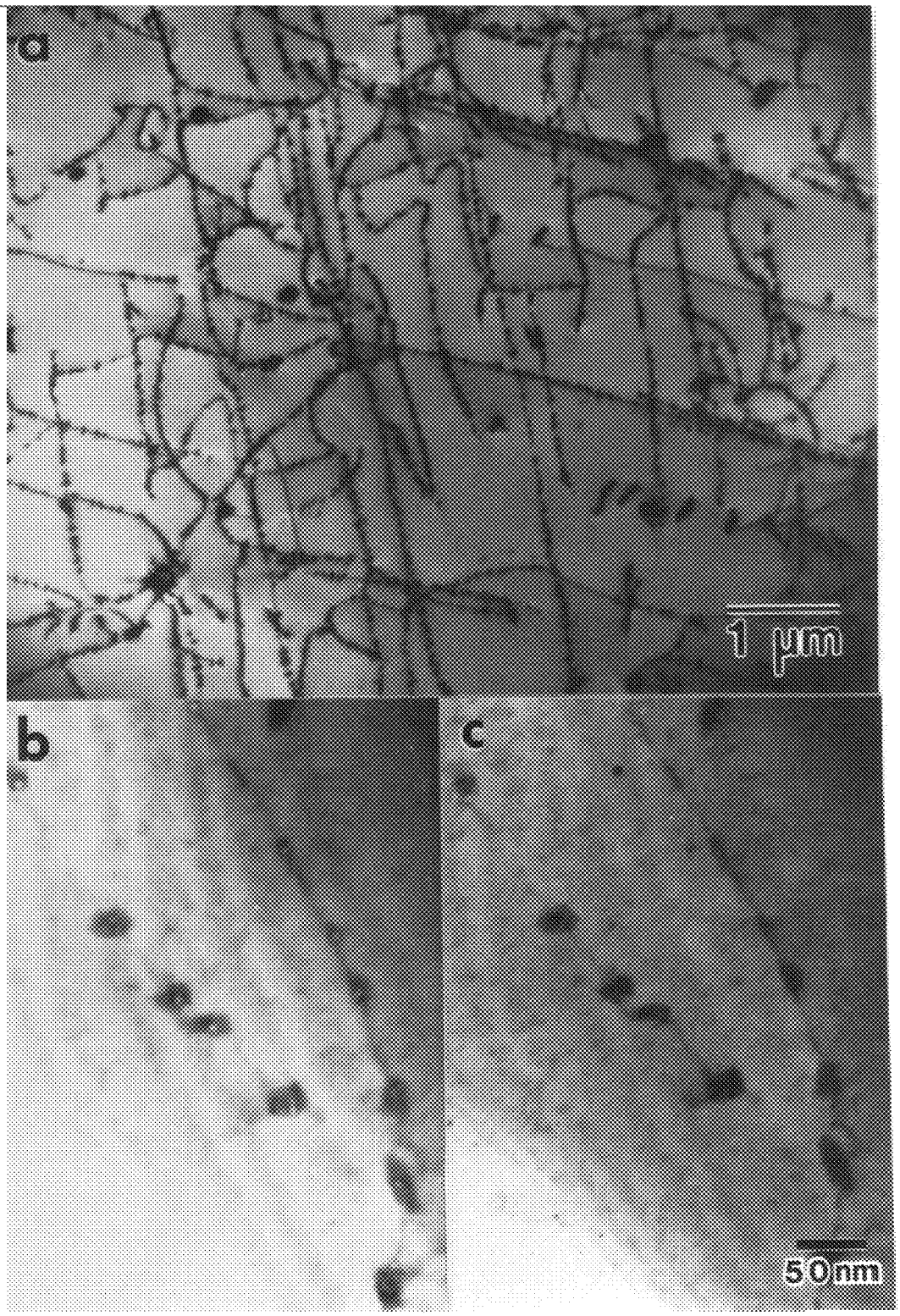
Figure 4. CA Type 304 SS after 1200° C-1 hour, water quench, and aging for 1000 hours at 600° C: (a) overview of cavity-carbide-dislocation morphology, (b) underfocus, and (c) overfocus bright-field image of details of cavity-carbide-dislocation interactions.

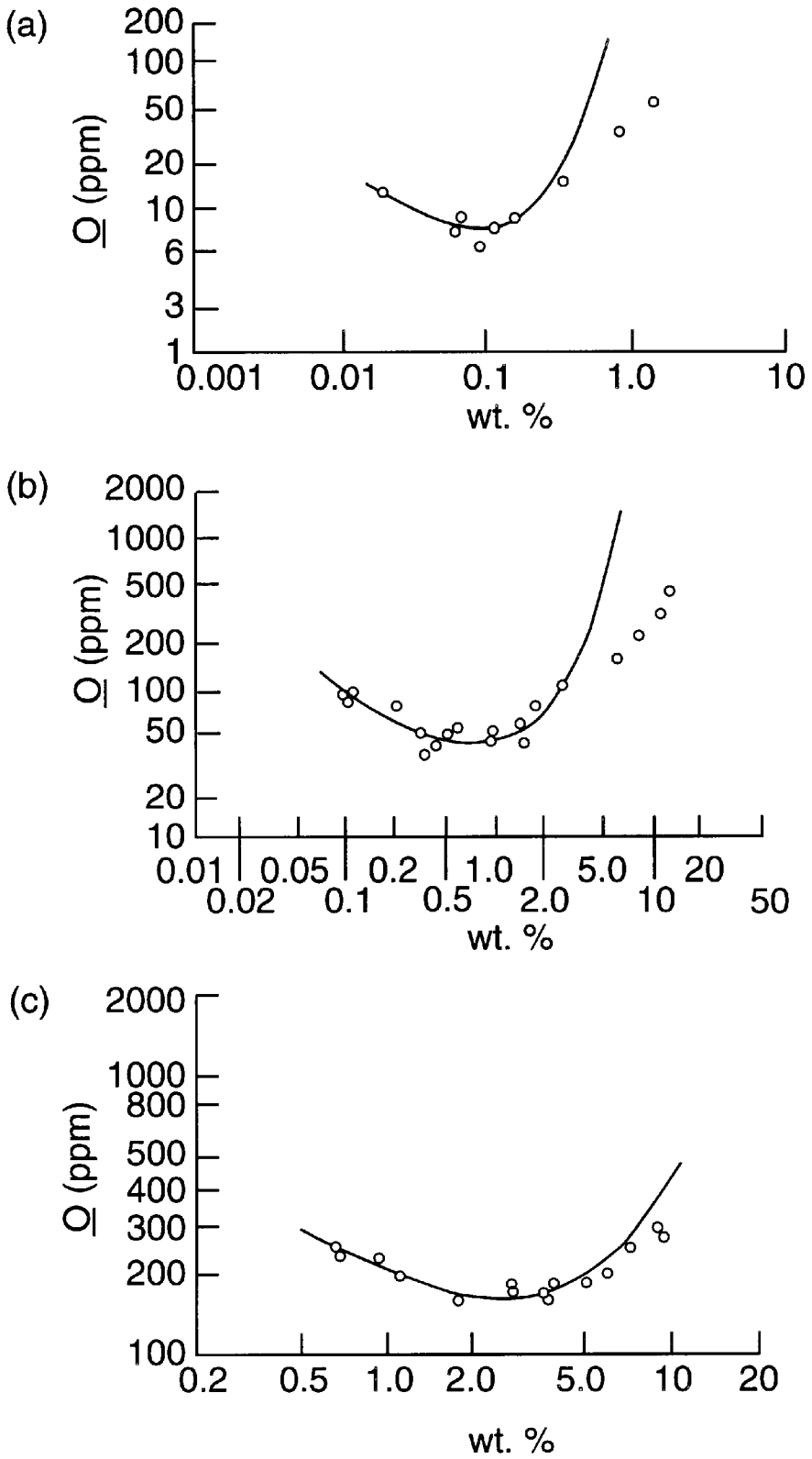
Figure 5. Solubility of oxygen in molten iron with: (a) aluminum, (b) titanium, and (c) vanadium additions.

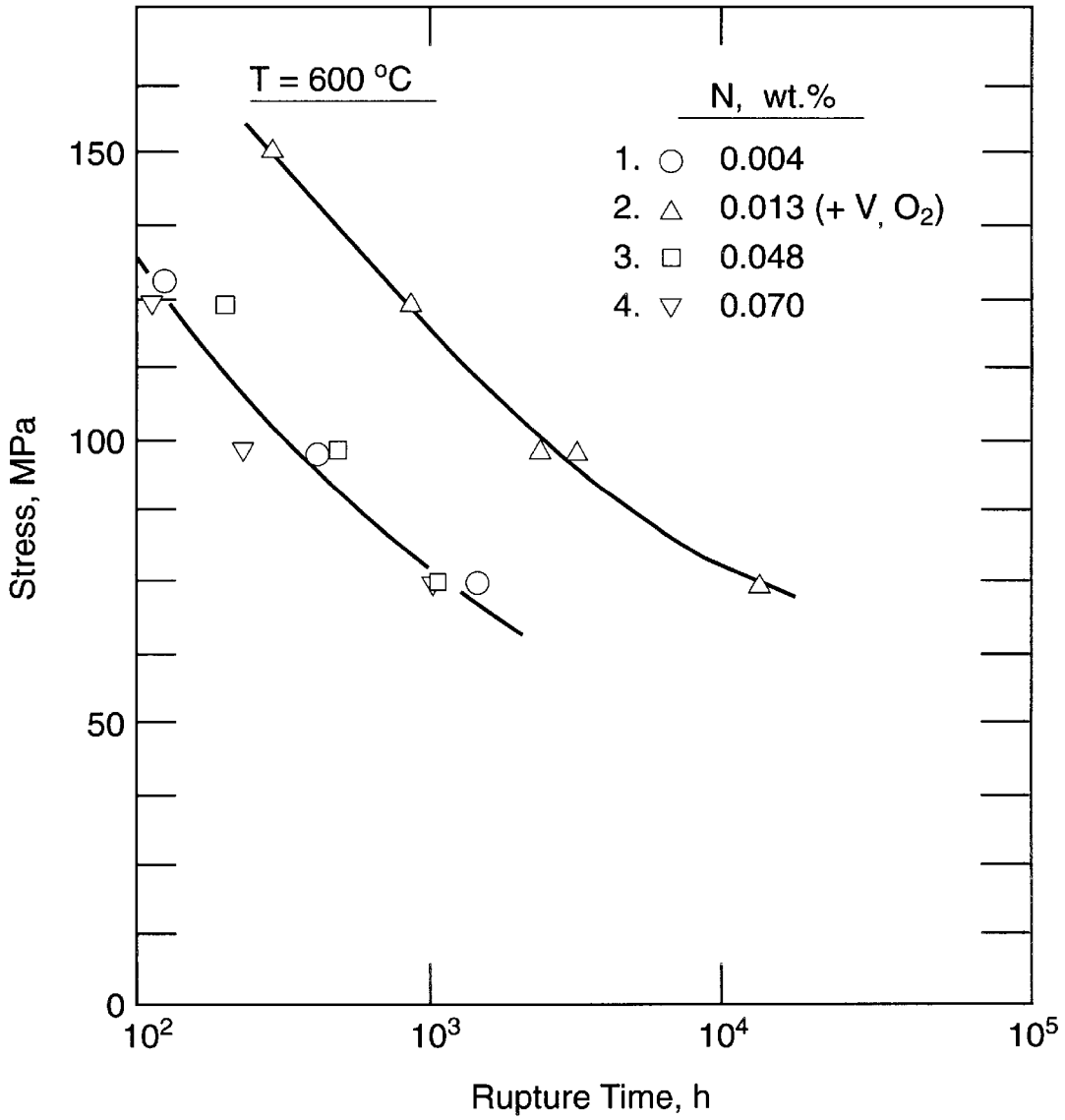
Figure 6. Stress-time-to-rupture creep behavior for RSP Fe-16Ni-9Cr alloys with various nitrogen contents. Alloy 2 (RFNCU2) contains V and O additions.

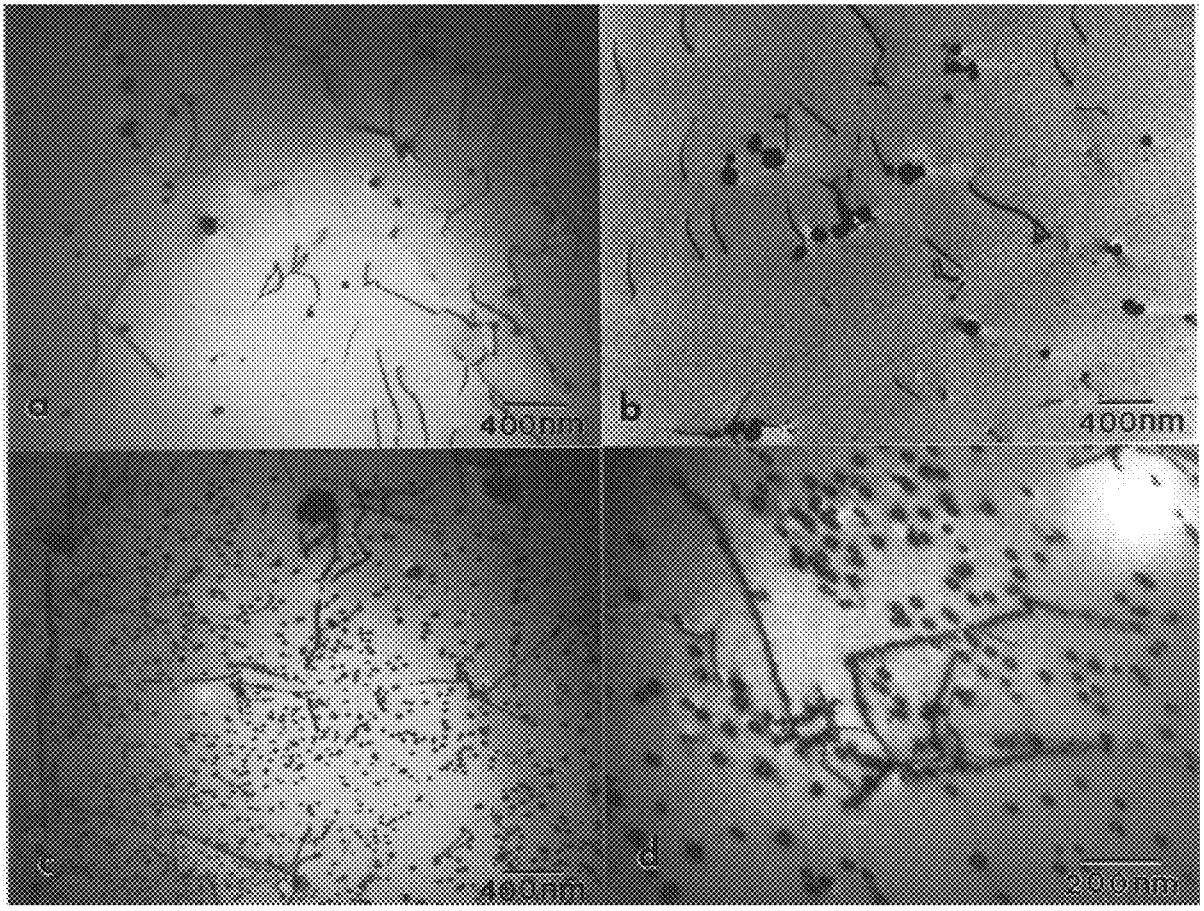
Figure 7. TEM microstructure for RSP Fe-16Ni-9Cr nitrogen series after aging 600° C; (a) 0.004 $N_2$, (b) 0.048 $N_2$, (c) 0.13 $N_2 + O_2$, and (d) 0.13 $N_2 + O_2$.

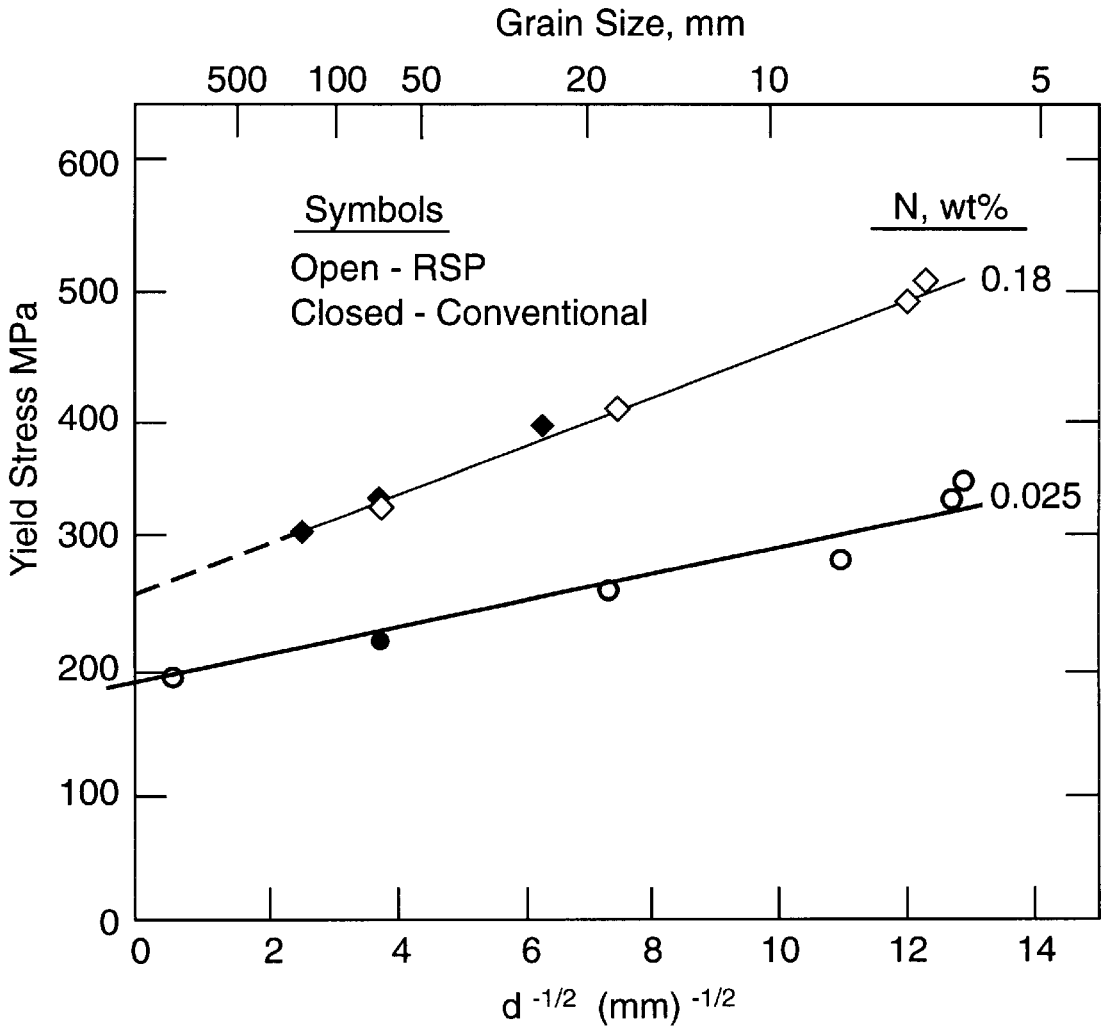
Figure 8. Influence of grain size on the yield stress of Type 31655 with different nitrogen contents.

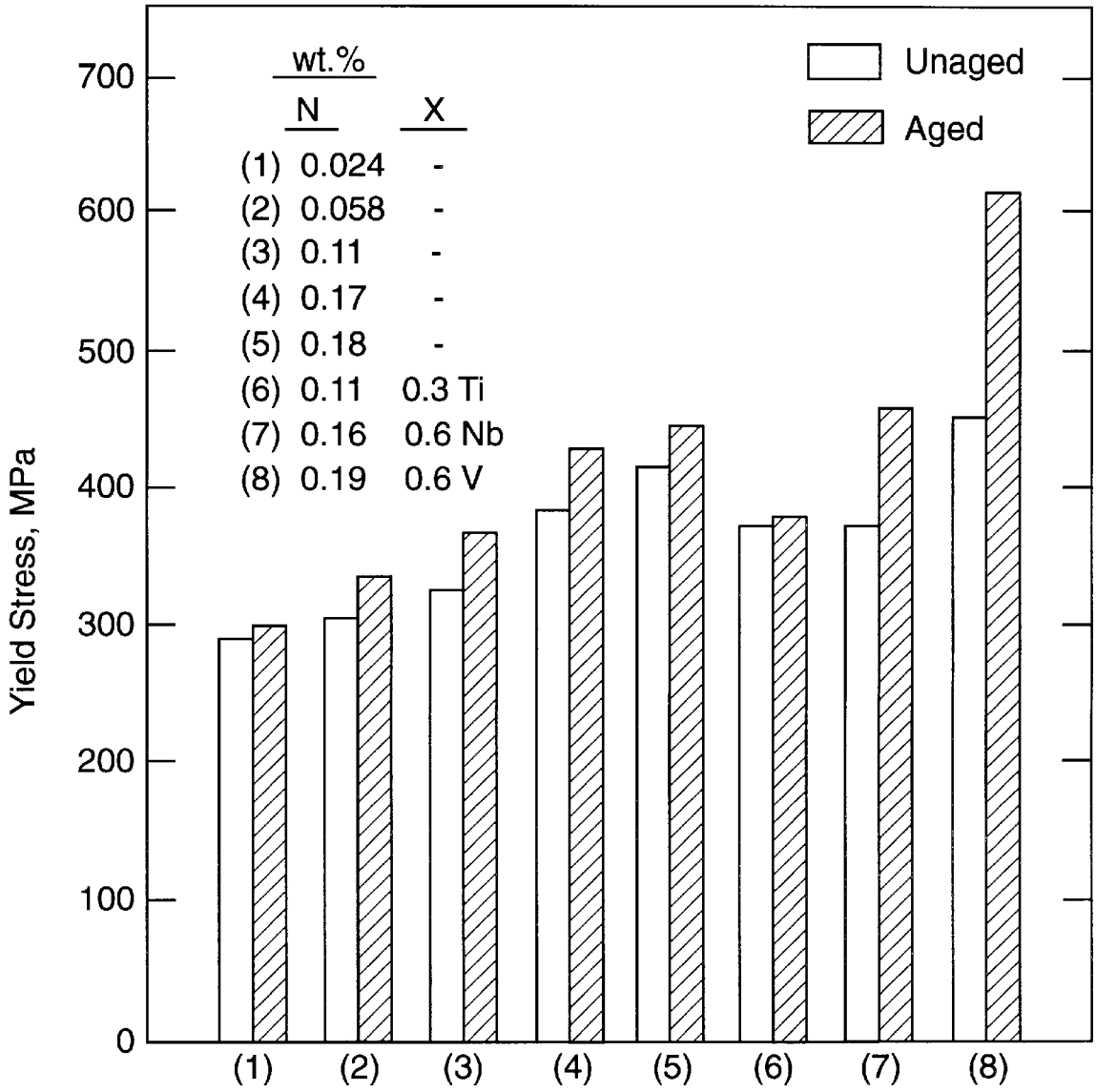
Figure 9. Influence from nitrogen and minor alloy additions on the room temperature yield stress for RSP Type 31655 before and after aging at 600 °C for 1000 hours.

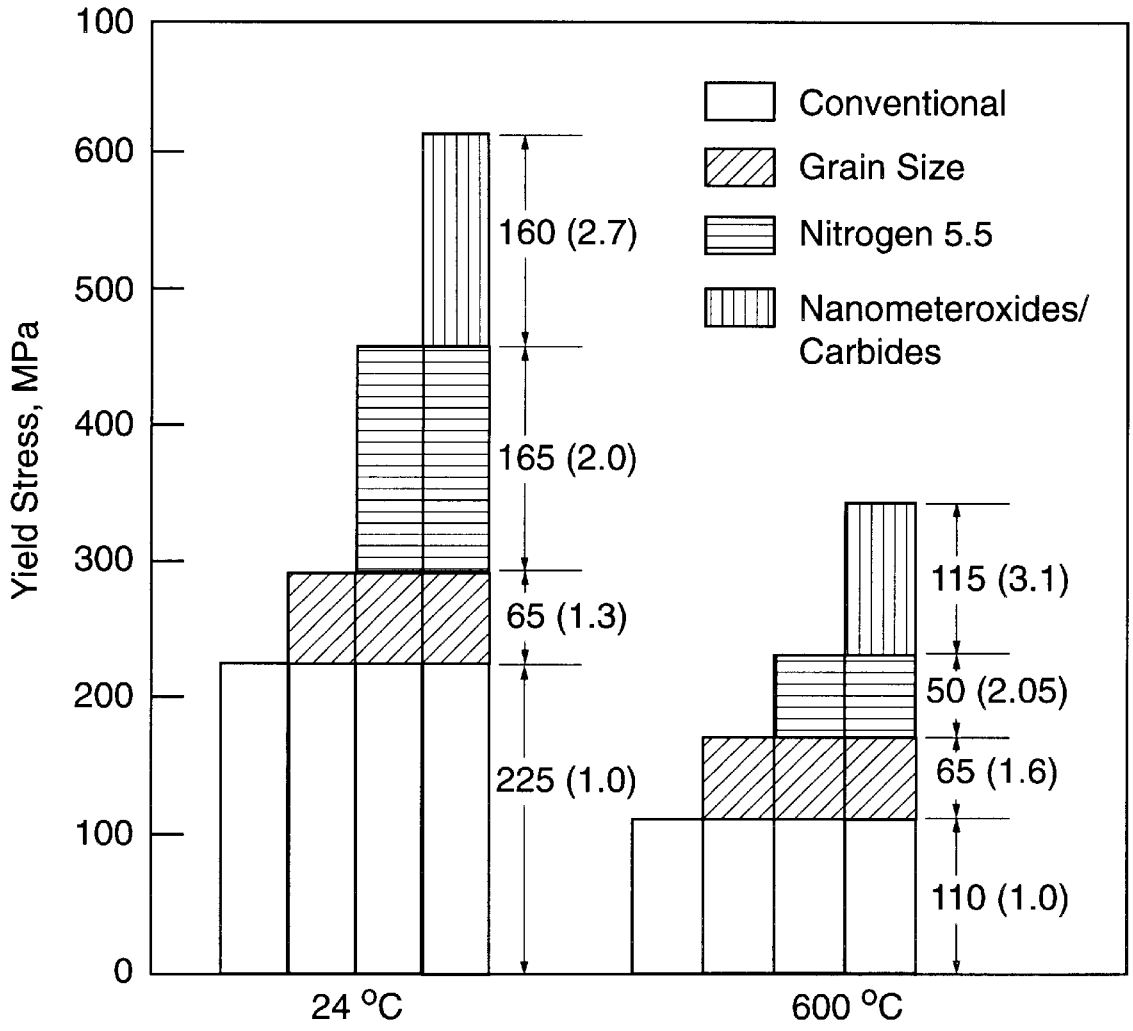
Figure 10. Accumulative strengthening contribution from RSP and effective use of interstitial elements in Type 31655.

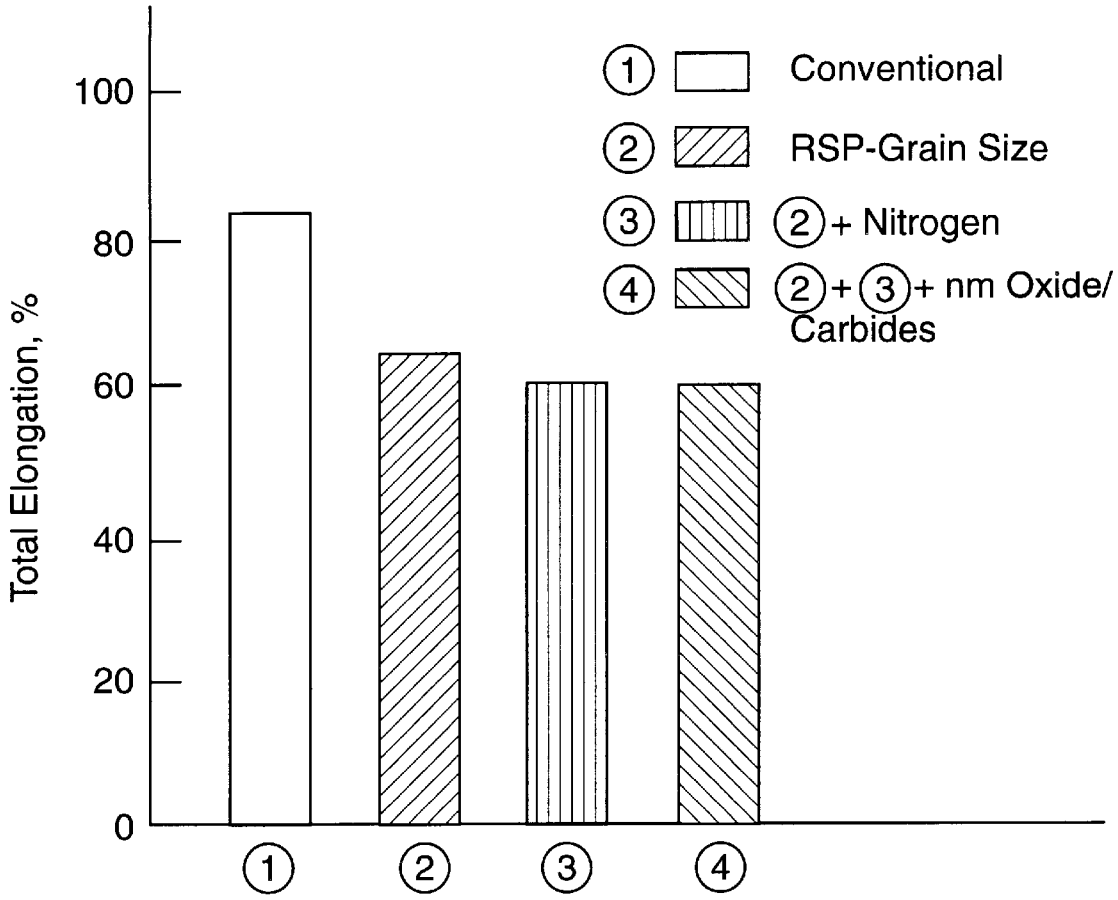
Figure 11. Accumulative effects from strengthening contributions using RSP and interstitial elements on the ductility of Type 31655.

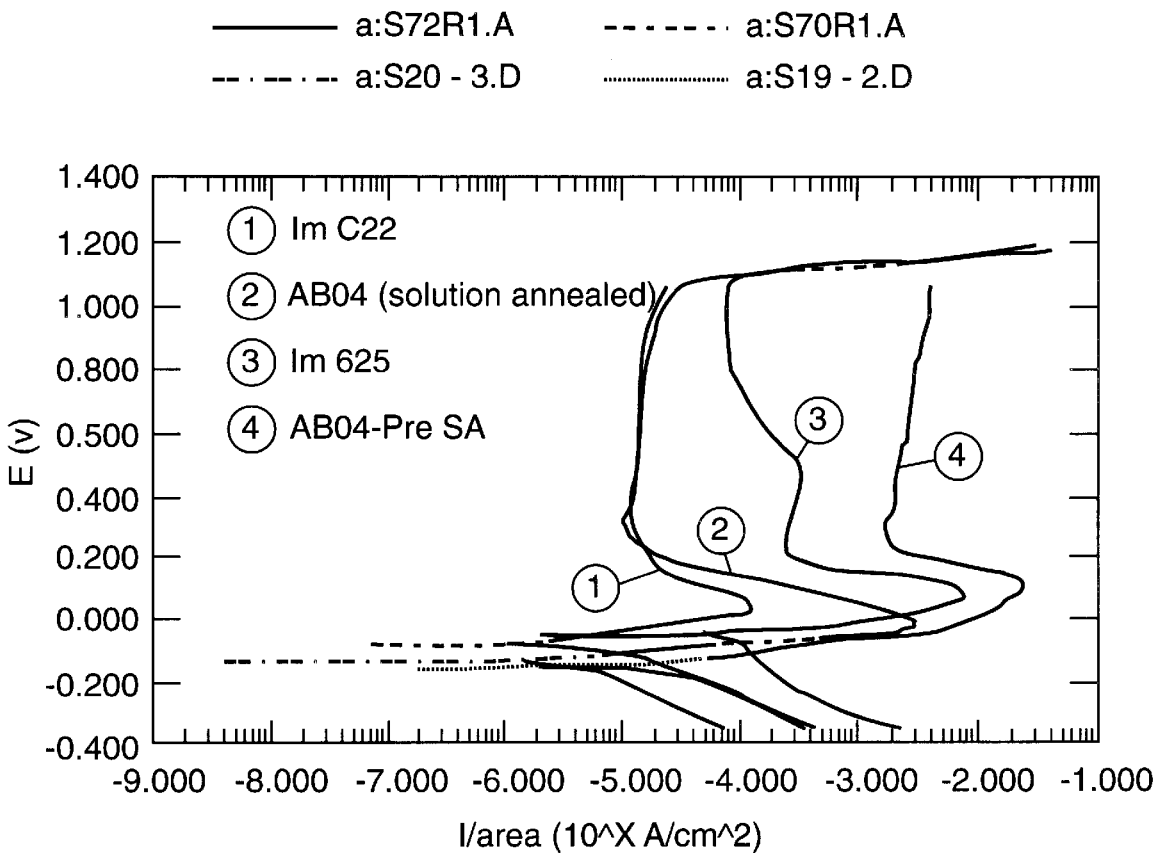
Figure 12. Electrochemical-Polarization curves for corrosion resistant alloys in 5 molar HCl.

STRENGTHENING OF METALLIC ALLOYS WITH NANOMETER-SIZE OXIDE DISPERSIONS

CONTRACTUAL ORIGIN OF THE INVENTION

The United States Government has rights in this invention pursuant to Contract No. DE-AC07-94ID13223 between Lockheed Idaho Technologies Company and The United States Department of Energy.

BACKGROUND OF THE INVENTION

1. Field of the Invention

This invention relates to austenitic stainless steels and nickel-base alloys, particularly such alloys, and methods of making the same, wherein the alloys are strengthened by nanometer-size hollow oxides which serve as nucleation sites for chromium-rich carbide precipitates within the alloy grains.

2. Prior Art

Strengthening of metallic alloys primarily is achieved through alloy grain size control, solute additions to a base metal to produce solid solution strengthening, and/or dispersion (precipitation or second phase) strengthening effects. These methods have been applied to a variety of metallic alloy systems and are the basis for strengthening of many of the high-value alloys available in the metal market today. For example, according to U.S. Pat. No. 4,758,405, high strength Al alloys have been produced by gas atomization of an Al alloy melt with an inert gas such as argon, helium or nitrogen containing 0.5–2% by volume of oxygen. U.S. Pat. No. 4,999,052 discloses austenitic stainless steels strengthened with nitrogen in solid solution and containing a dispersant such as a nitride, for example, titanium nitride, and/or an oxide such as yttria. The role of nitrogen in iron-base alloys, particularly austenitic stainless steels, has received considerable attention during the past 80 years. Two fairly recent symposia on this subject have provided state-of-the-art reviews. *Proceedings of the International Conference on High-Nitrogen Steels*-88, Editors J. Foct and A Hendry, Publ. Institute of Metals, London GB (1988); *Proceedings of the International Conference on High-Nitrogen Steels*-90, Editors G. Stein and H. Witulski, Publ. Verlag Stalil Eisen, MbH, Dusseldorf (1990).

Alloy 654SMO is a relatively new austenitic stainless steel of high strength and good corrosion resistance. B. Wallen, M. Liljas and P. Stenvall, *Avesta* 654 *SMO—a New High Molybdenum, High Nitrogen Stainless Steel*, Avesta Corrosion Management, Avesta AB, S-774 80 Avesta, Sweden.

An overview of mechanisms for strengthening austenitic stainless steels is provided by K. J. Irvine et al., "High-Strength Austenitic Stainless Steels," *Journal of The Iron and Steel Institute*, October 1961.

Alloys 625 and 718 are representative of high strength nickel-base alloys. H. L. Eiselstein et al. "*The Invention and Definition of Alloy* 625," Inco Alloys International, Inc, P.O. Box 1958, Huntington, W. Va., *Superalloys* 718, 625 *and Various Derivatives, E. A Loria, Ed.*, The Minerals, Metals & Materials Society, 1991. Such alloys have been produced by the powder metallurgy process. F. J. Rizzo et al. "Microstructural Characterization of PM 625-Type Materials," Crucible Compaction Metals, McKee and Robb Hill Roads, Oakdale, Pa. 15071 and Purdue University, West Lafayette, Ind. 47906, included in *Superalloys* 718, 625 *and Various Derivatives, E. A Loria, Ed.*, The Minerals, Metals & Materials Society, 1991. See also R. B. Frank "Custom Age 625 Plus Alloy—A Higher Strength Alternative to Alloy 625, Carpenter Technology Corporation, P.O. Box 14662, Reading, Pa. 19612, also included in *Superalloys* 718, 625 *and Various Derivatives, E. A Loria, Ed.*, The Minerals, Metals & Materials Society, 1991.

However, the options for improving the properties and performance of metallic alloys are becoming limited in terms of new developments, and new, innovative methods are needed in order to provide a new generation of advanced alloys that can stand up to increasingly severe future demands.

SUMMARY OF THE INVENTION

This invention provides new compositions and methods for producing alloys, particularly austenitic stainless steels and nickel-base alloys, having enhanced strength with good retained ductility. Such alloys are produced by forming a liquid melt containing an effective amount to about 3 weight percent or less of vanadium, carbon and/or nitrogen in total amount of 1.0 weight percent or less, atomizing the melt, by centrifugal spraying or gas atomization, while introducing a limited amount of oxygen into the atmosphere above the melt to provide a critical dissociated oxygen level in the melt which is quenched in during particle solification, and resulting in the production of large numbers of 7–10 nanometer-size hollow oxides which form nucleation sites for the precipitation of strengthening carbides and/or nitrides inside the alloy grains.

The aforesaid processing also produces another type of oxide, having an average size of about 50 nanometers, which serves to pin alloy grain boundaries and thereby provide a fine grain size which also contributes to alloy strengthening.

Due to a critical nitrogen content, the alloys of the invention are still further strengthened by nitrogen solid solution.

BRIEF DESCRIPTION OF THE DRAWINGS

FIG. 1 is a graph relating percent strain and time and showing the enhanced creep strength of a centrifugally atomized (CA) Type 304 stainless steel alloy of the invention with hollow oxide dispersions as compared to ingot metallurgy (IM) and conventionally processed and inert gas atomized (IGA) alloys.

FIGS. 2 A–C are photomicrographs showing the 8 nanometer hollow oxide cavities produced in accordance with the invention.

FIG. 3 is a graph showing the X-ray spectrum from 8 nanometer hollow oxide cavities in Type 304 stainless steel centrifugally atomized in accordance with the invention.

FIGS. 4 A–C are photomicrographs of Type 304 stainless steel, centrifugally atomized in accordance with the invention, after a 1200° C., 1 hour water quench and aged for 1000 hours at 600° C.

FIGS. 5 A–C are graphs relating oxygen content, in iron, and weight percent of, respectively, Al, Ti and V additions to the iron base.

FIG. 6 is a graph relating stress to rupture time for rapidly solidified Fe-16Ni-9Cr alloys with varying nitrogen contents, and with vanadium and oxygen additions.

FIGS. 7 A–D are photomicrographs of rapidly solidified Fe-16Ni-9Cr-N alloys versus the same alloy with vanadium and oxygen and showing the proliferation of second phase carbide precipitates nucleated on approximately 7 nanometer-size hollow oxides after aging at 600° C.

FIG. 8 is a graph relating yield stress and grain size for Type 316 stainless steel with different nitrogen contents and produced conventionally and in accordance with the invention.

FIG. 9 is a bar graph relating room temperature yield strength to nitrogen and minor alloy additions to a rapidly solidified Type 316 stainless steel in the unaged condition and aged at 600° C. for 1000 hours.

FIG. 10 is a bar graph showing yield strength contributions by conventional processing, grain size control, nitrogen solid solution strengthening, and nanometer-size oxides nucleating precipitated carbides.

FIG. 11 is a bar graph relating room temperature total percent elongation of Type 316 stainless steel to the effects contributed by (1) conventional processing, (2) alloy rapidly solidified in accordance with this invention to provide grain size control, (3) factor (2) plus nitrogen in solid solution, and (4) factors (2) and (3) plus nanometer-size hollow oxides nucleating carbide precipitates.

FIG. 12 is a graph showing electrochemical polarization curves in 5-molar HCl for an alloy of the invention and, for comparison, prior art corrosion-resistant alloys.

DESCRIPTION OF PREFERRED EMBODIMENTS

Three heats of Type 304 stainless steel were made, as shown in Table 1.

TABLE 1

| | Composition, Wt. % | | | | | | | | | | | | |
|---|---|---|---|---|---|---|---|---|---|---|---|---|---|
| Alloy | Fe | Cr | Ni | Mn | Si | Mo | Al | V | Nb | Ti | O | N | C |
| CA[a] | Bal. | 18.4 | 9.1 | 0.8 | 0.65 | 0.6 | 0.01 | ND | ND | 0.01 | 0.01 | 0.03 | 0.05 |
| IGA[b] | Bal. | 18.5 | 9.8 | 1.2 | 0.5 | 0.3 | 0.01 | 0.04 | 0.05 | 0.01 | 0.03 | 0.03 | 0.05 |
| IM[c] | Bal. | 18.4 | 9.9 | 1.3 | 0.5 | 0.3 | 0.01 | 0.01 | 0.05 | 0.01 | 0.01 | 0.03 | 0.05 |

[a]CA = centrifugally atomized. V and Nb content not determined (ND).
[b]IGA = inert gas atomized (using helium)
[c]IM = ingot metallurgy or conventionally processed. This material was melt stock for IGA.

Alloy CA in Table 1, a rapidly solidified (RS) steel, was prepared by centrifugally atomizing a melt of the steel to break up a fine melt stream into small molten droplets that were subsequently rapidly cooled by convection with helium gas. The solidified powder was consolidated into bar form by hot extrusion at 900° C. preheat and an extrusion ratio of 8 to 1. Alloy IGA was similarly processed, but using helium gas atomization and processed in a manner to promote rapid solidification levels at least comparable to the processing of the CA alloy. The IGA powder was then consolidated by hot extrusion.

Creep tests were performed as shown in FIG. 1 providing a strain versus time curve at 600° C. and a loading stress of 195 MPa. As will be seen from FIG. 1, the creep strength of Alloy CA is remarkably greater than that of either Alloy IM or Alloy IGA, lasting at least 60-fold longer than the latter alloys.

The remarkable difference in creep strength of these alloys prompted further investigation into the cause of this phenomenon. High resolution analytical electron microscopy examination of the CA alloy revealed the presence of a large number of small, i.e. approximately 8 nanometer (nm) cavities within the CA-Type 304 stainless steel extruded powder. The latter material was annealed over the temperature range of 900° to 1200° C. for 1 hour, and it was found that the cavity size did not change with such heat treatment. An example of the 8 nm cavities observed in the CA-Type 304 stainless steel is shown in the photomicrographs of FIGS. 2A–2C which were produced using a through-focal transmission electron microsopy technique as described by Ruehle, "Transmission Electron Microscopy of Radiation-Induced Defects," *Radiation Induced Voids in Metals*, Proc. Conf. held in Albany, N.Y., June 1971, USAED (1972), 255, and Ruehle and Wilkens, *Crystal Lattice Defects,* 6, (1975), 129–140. This examination technique permits the detection of very small defects that are of low mass density, such as cavities or voids. For the underfocused condition, the low density defects (cavities) appear as light images (FIG. 2B), and for overfocused conditions as dark images (FIG. 2C).

The composition associated with the 8 nm cavities was determined using energy-dispersive x-ray signals on a VG HB501 scanning transmission electron microscope (STEM). The x-ray signals due only to the cavities are shown in FIG. 3. These results, along with the through-focal imaging, show that the cavities are hollow oxides. The elements Al, Nb, Ti and V associated with the oxide film on the cavities were present as impurities or trace elements in the CA-Type 304 stainless steels which were tested as above described. The confirmation that the cavities are hollow oxides explains their lack of growth, hence stability, after heat treatments from 900 to 1200° C., and it was concluded that their formation is associated with the rapid solidification processing of the CA-Type 304 stainless steel and its composition, particularly in respect to oxygen and the metallic oxide formers.

This finding of such hollow oxides is believed to be the first such observation, although similar voids have been observed in highly irradiated austenitic stainless steels. K. Nakata et al. "Void Formation and Precipitation During Electron-Irradiation in Austenitic Stainless Steels Modified with Ti, Zr and V," *Journal of Nuclear Materials,* 148 (1987) 185–193.

The importance of the nanometer size, hollow oxides lies in their role of increasing the level of strengthening, and accounts for the remarkable behaviour of the CA-Type 304 stainless steel as shown in FIG. 1.

Aging heat treatments were performed on the CA-Type 304 stainless steel extruded powder after annealing for 1 hour at 1200° C. FIGS. 4A–4C are high resolution TEM photomicrographs of the CA-Type 304 stainless steel after an anneal at 1200° C. for 1 hour, followed by water quenching, and aging for 1000 hours at 600° C. FIG. 4A shows a dislocation (linear defect) arrangement in the specimen after the heat treatments. On the dislocations are a relatively uniform distribution of precipitates due to the aging treatment. Higher magnification resolution of the dislocation/precipitates is shown in FIGS. 4B and 4C after through-focal imaging. Inside of each of the precipitate particles is an 8 nm hollow oxide. Thus the hollow oxides serve as very effective nucleation sites for precipitate development during aging.

The precipitates developed during aging have been identified as chromium-rich carbides, and it is these hollow oxide-nucleated precipitates which are responsible for the marked improvement in creep resistance shown in FIG. 1.

The foregoing findings provided incentive to determine if the hollow oxides could be reproduced through compositional adjustments to the alloys and using rapid solidification processing with gas atomization.

The aforesaid test results indicated that two factors required to achieve the observed enhanced strengthening are vacancy (missing atom sites) supersaturation, and a certain level of dissociated oxygen, i.e. oxygen content not tied up as a compound. Rapid solidification processing, by the atomization of a melt stream into fine droplets that are rapidly cooled by their convective interaction with gas, e.g. Ar, He, or $N_2$, provides an opportunity for development of vacancy supersaturation. Coalescence of the vacancies to form clusters, e.g. voids or cavities, appeared to be a critical step towards formation of the stable 8-nm, hollow oxides. Dissociated oxygen present in the molten metal droplets quickly diffuses to the voids/cavities after solidification. Further, it appeared likely that the cations for forming the oxide film around the voids or cavities are the high-formation energy oxide formers such as those shown in FIG. 3. A significant concern regarding the intentional addition to the alloy of a significant concentration of oxide-forming cations would be their ability to deoxidize the melt prior to atomization and solidification. Such behavior essentially would strip the melt of the dissociated oxygen necessary to stabilize the voids or cavities. The primary elements of concern for deoxidation propensity are the impurity or trace elements Al, Ti, V, and Nb shown in FIG. 3 to be present in the CA-Type 304 stainless steel and associated with the 8 nm hollow oxides. The influence of such additions on the solubility of oxygen in iron has been studied and reported by Lupis, *Chemical Thermodynamics of Materials*, Elsevier Science Publishing Co., New York, N.Y., (1983), pages 257–258. Results for Al, Ti and V additions are shown in FIGS. 5A–5C, from which it is evident that Al and Ti additions greatly reduce the solubility of oxygen in iron, whereas V additions promote much higher oxygen solubility in iron. Niobium additions would be expected to provide oxygen solubility similar to V.

Accordingly, a melt was made comprising, in wt. %, Fe-16Ni-9Cr-1.5Mn-0.04C containing 0.3 wt. % V addition. The melt was performed under Ar, with approximately 0.01 volume fraction of oxygen. The gas environment over the melt was pressurized to 20 p.s.i.g. The alloy melt was heated to 1740° C. (about 290° C. superheat) and atomized into powder using helium. The gas atomized powder was consolidated into a bar by hot extrusion at 900° C. preheat and an extrusion ratio of 10.5 to 1. Three other heats were made of the same composition, but not containing V nor did their processing provide an intentional oxygen partial pressure in the melt cover gas. These latter powders also were consolidated into bar by hot extrusion. A comparison of the creep behavior (stress-time-to-rupture), at 500 and 600° C., for these materials, after a 1000° C., 1 hour heat treatment, is shown in FIG. 6. From that Fig. it can be seen that the alloy containing the oxygen and vanadium additions has superior creep resistance as compared to the three alloys processed in the same way and having the same composition except for no oxygen or vanadium additions.

High resolution TEM examinations were performed on the four alloys of this latter series after aging at 600° C. for 500 and 800 hours, and representative photomicrographs are shown in FIGS. 7A–7D. Although second phase/precipitates are present in alloys 1, 3 and 4 (FIGS. 7A and 7B), the population is substantially larger for Alloy 2 with the oxygen-vanadium addition (FIGS. 7C and 7D). Although not shown, TEM examinations on the alloys, before aging, showed a high population of 7 nm cavities for Alloy 2, but not for the other alloys without the oxygen-vanadium additions. These 7 nm cavities, or hollow oxides, provided the nucleation sites for precipitation of vanadium carbides during the aging cycle and which carbides are responsible for the superior creep behavior of Alloy 2 as shown in FIG. 6.

A further heat, designated 316VNO, was prepared, under cover of nitrogen plus 0.01 volume fraction of oxygen, for gas atomization with nitrogen, and having a composition as shown in Table 2.

TABLE 2

| Element | Weight percent |
|---|---|
| iron | balance |
| chromium | 16.6 |
| nickel | 10.7 |
| molybdenum | 2.3 |
| manganese | 1.6 |
| silicon | 0.7 |
| aluminum | less than 0.01 |
| titanium | less than 0.01 |
| vanadium | 0.65 |
| niobium | 0.03 |
| oxygen | 0.047 |
| nitrogen | 0.19 |
| carbon | 0.018 |

The powders of the Table 2 316VNO composition were consolidated into bar by hot extrusion (900° C. preheat and an extrusion ratio of 10.5 to 1).

Creep tests, after a 1 hour, 1100° C. preconditioning heat treatment, were performed on the Table 2 Type 316VNO alloy as compared to conventionally processed Type 316 stainless steels and other rapidly solidified stainless steels. The results of such tests, performed at 600° C. and 400 MPa stress level, are shown in Table 3.

TABLE 3

| Alloy | Rupture Time, Hours |
|---|---|
| CP[a] nominal strength[1] | 1.3 |
| CP[a] high strength[1] | 9.1 |
| RSP[b] high nitrogen[2] + 0.6 Nb | 1000 |
| RSP[b] high nitrogen[3] | 1150 |
| RSP[b] Type 316VNO | 2200 |

[a]Conventionally processed.
[b]Rapid Solidification Processing, i.e. by gas atomization.
[1]0.057C—1.86Mn—0.024P—0.019S—0.58Si—13.48Ni—7.25Cr—2.34Mo—0.02Co—0.10Cu—0.03N—0.0005B—0.02Ti—0.003Pb—0.004Sn-bal Fe; as described by Brinkman, Booker, Sikka and McCoy, Long Term Creep and Creep-Rupture Behavior of Types 304 and 316 Stainless Steel, Type 316 Casting Material (CF8M), and 2¼Cr—1Mo Steel - a Final Report, ORNL/TM-9896, Oak Ridge National Laboratory (1986), pages 5, 60.
[2]16.6Cr—10.3Ni—2.1Mo—0.6Si-less than 0.01Al-less than 0.01Ti—0.1V—0.6Nb—.0036O—0.16N—0.016-C-bal Fe.
[3]Same as [2] without Nb.

From the Table 3 data, it is apparent that the RSP Type 316 stainless steels have superior creep lifetimes as compared to the similar conventionally processed steels, and that the inventive alloy Type 316VNO exhibits additional improvement as compared to the other RSP Type 316 stainless steels.

The rupture life of the Table 2 alloy has exceeded that of conventionally processed Type 316 stainless steel by at least a thousand-fold.

High resolution TEM examinations have been performed on the Table 2 alloy and a very large population of fine (about 40 nm) vanadium carbide/nitride precipitates have been observed after aging of the alloy for 1000 hours at 600° C.

The approximately 8 nm size hollow oxides described above serve as nucleation sites for carbide/nitride precipitates inside the grains of the metallic microstructure during aging. Rapid solidification processing, as well as conventionally processed alloys where the nanometer size hollow oxides were not observed, showed no evidence of carbide/nitride precipitation inside the grains after aging. For these latter materials, carbides formed after aging were only found along grain boundaries.

A second form of oxide particles was observed in the stainless steels having vanadium and oxygen additions in accordance with this invention. These oxides have an average size of about 50 nm, are stable to high temperatures, and are primarily associated with metallic impurities in the alloys, consisting predominantly of aluminum oxides ($Al_2O_3$), although x-ray analysis performed on these oxide dispersions showed that $SiO_2$, MnO, NbO, and $TiO_2$ particles were occasionally present. These solid oxide dispersions are distinctly different from the approximately 8 nm hollow oxides derived from vacancy condensation (i.e. voids) and the association of the latter with vanadium. The population of these solid oxides is far less than the population of the hollow oxides, and the amount of oxygen tied up with these solid oxides is quite small, considerably less than the total oxygen measured in the alloys after powder consolidation. For their formation in significant amount, sufficient to provide the observed grain boundary pinning effect, a small but effective amount of Al is needed, e.g. less than 0.05 wt % and particularly at least about 0.005 wt. %. Oxygen contents of about 0.005 wt. %, particularly about 0.01 wt. %, to about 0.1 wt. % appear to be sufficient to provide for both the solid oxides and the hollow oxides, where, for the latter, vanadium also must be present. Where the vanadium content of these alloys was below 0.05–0.1 wt. %, very few hollow oxides were observed, and hence no significant improvement in creep properties after aging was obtained. It can be expected that Nb additions will tolerate oxygen solubilities similar to V and, consequently, that Nb can be used at least in partial substitution for V in the alloys of the invention. In this regard, Nb normally should be restricted to relatively low levels under 1 wt. %, preferably about 0.5% max. and most preferably about 0.05 wt. % max., although larger amounts, e.g. up to about 6 wt. % can be used, particularly in the nickel-base alloys.

Carbon's role in the strengthening of iron- and nickel-base alloys has been fairly well established, i.e., solid solution by dissociated carbon and carbide precipitates for dispersion strengthening. For the present invention, carbides are directly associated with the nm-size hollow oxides and vanadium-related dispersions described above, that is, the nm-size oxides serve as effective nucleation sites for carbide precipitates inside the grains during aging. For this purpose, at least about 0.01 wt. % and up to about 0.08 wt. % carbon is necessary.

The primary role of nitrogen in metal alloys, particularly those with an austenite, i.e. face centered cubic (f.c.c.) type structure, is solid solution strengthening. Nitrogen is the most potent elemental addition for this purpose. Nitrogen also has the propensity for forming nitrides which can provide dispersion strengthening contributions to the overall strength of an alloy.

The alloys of the invention are strengthened by a combination of factors, including carbide and nitride dispersions nucleated on the nm-size hollow oxides inside the alloy grains, by nitrogen solid solution, and by a stable, fine grain structure resulting from the larger, approximately 50 nm, solid oxides which are present in sufficient numbers in the inventive alloys to attribute to these oxides a stabilizing and refining pinning effect on the alloy grains.

The effective use of the interstitial elements as alloy additions achieved by rapid solidification processing of a melt containing oxygen and vanadium cannot be achieved by conventional processing practices.

The effects of grain size, nitrogen, and Ti, V, or Nb additions on the mechanical properties of Type 316 stainless steel processed from rapidly solidified, gas atomized powders and consolidated by hot extrusion were determined by comparing the alloy of Table 2, Type 316VNO, with conventionally processed Type 316 stainless steel. The effects of nitrogen and grain size on the 0.2% offset yield strength from tensile testing at room temperature are shown in FIG. 8. The results show several significant features: (1) empirical correlation of $sigma_y = sigma_o + kd^{-1/2}$, where $sigma_y$ is the 0.2% offset yield stress, $sigma_o$ is the intercept at $d^{-1/2}=0$ or an infinitely large grain size and is commonly referred to as the matrix stress, k is the slope and provides a measure of strengthening from the grain boundaries, and d is the average grain diameter in mm; (2) nitrogen content has a significant effect on the strengthening contribution from both $sigma_o$ and k; and (3) the behavior between rapidly solidified and conventially processed alloys are comparable. The high nitrogen results for the conventionally processed Type 316 stainless steel are from Norstrom, "The Influence of Nitrogen and Grain Size on Yield Strength in Type AISI 316L Austenitic Stainless Steel," *Metal Science*, Vol. 11 (June 1977), pages 208–212. A very significant feature regarding the results shown in FIG. 8 is the range in grain sizes.

For the rapidly solidified Type 316VNO alloy, grain sizes were determined after 1 hour heat treatments at 1000°, 1100° and 1200° C. The average grain sizes were 0.007, 0.007, and 0.010 mm, respectively, demonstrating that the processing of that alloy has enabled fine grains, stable to high temperatures, to be obtained. The small grain sizes obtained from the inventive alloys processed by rapid solidification cannot be achieved by conventional processing, at least in terms of a fully recrystallized (i.e. heat treated) product. As above described, the stable, fine grain sizes observed for the inventive alloy are attributed to the approximately 50 nm solid oxide dispersions which are believed to be responsible for pinning the grain boundaries and hence restricting grain growth.

A further series of heats were made for the purpose of comparing the yield strength of the Type 316VNO alloy with similar alloys containing various nitrogen contents as well as varying alloying additions of Ti and Nb. Tensile specimens for these heats, made from rapidly solidified and consolidated powders, were heat treated for 1 hour at 1100° C., in addition to aging the specimens at 600° C. for 1000 hours. Tensile tests were performed at room temperature and 600° C. before and after aging. The room temperature 0.2% offset yield stress is shown in FIG. 9. The results for the Type 316VNO alloy are shown at the far right of FIG. 9, under test No. (8). It is apparent from these results, that there is a significant gain in strengthening from nitrogen. In all cases, some additional strengthening is obtained by aging, but the most pronounced effect is seen in the Type 316VNO alloy, containing 0.65V, where an additional amount of strengthening of 160 MPa is achieved. This latter strengthening contribution after aging is attributed to vanadium carbides/nitrides that have nucleated on the small, nm-size hollow oxides that were formed by the rapid solidification processing in conjunction with oxygen.

Contributions to strengthening from the interstitial elements in the Type 316VNO alloy of Table 2 are illustrated in FIGS. 10A and 10B in terms of 0.2% offset yield stress at, respectively, room temperature and 600° C. From those Figs., it can be seen that, at room temperature, the yield stress for the Type 316VNO alloy increased from 225 MPa, at the conventional processing level, to 615 MPa, and, at 600° C., from 110 MPa (conventional processing) to 340 MPa. The numbers in parentheses to the right of the bar graphs of FIGS. 10A and 10B represent the fractional increases in strengthening from (1) grain size, (2) nitrogen solid solution, and (3) from nm-size hollow oxides serving as nucleation sites for vanadium carbides/nitrides during aging. TEM examination of the Type 316VNO alloy before aging showed no evidence of carbides/ nitrides; however, after aging, a very high population of vanadium carbides/ nitrides was observed. The average diameter of these precipitates was about 40 nm.

Although not shown, the ultimate tensile strength of the Type 316VNO alloy was found to exhibit a significant increase as compared to similar testing of conventionally processed Type 316 stainless steel. At room temperature, the ultimate tensile stresses were 922 MPa and 565 MPa for, respectively, the Type 316VNO alloy and conventionally processed Type 316 stainless steel. A very significant benefit observed for the rapid solidification processing in the production of the inventive alloys is the retention of high ductility. From the aforesaid tensile tests, ductility indicators were determined by total elongation and reduction in area measurements. The total elongation behavior, at room temperature, of conventionally processed Type 316 stainless steel and rapidly solidified Type 316VNO alloy is shown in FIG. 11. Although a reduction in total elongation occurs from the substantial strengthening due to grain size, nitrogen solid solution, and vanadium carbide/nitride precipitates nucleated on the nm-size hollow oxides, the retained level is very substantial, such that the inventive alloys can be viewed as being quite ductile.

In further illustration of the strength and ductility of the alloys of the invention, an experimental alloy containing, by wt. %, 20Ni-25Cr-8Mo-0.5V-0.06C-0.2N-0.01-0-bal.Fe (Alloy ABD4) was prepared by induction melting, under nitrogen, of a 15 pound ingot. Temperature of the melt prior to gas atomization was about 1700° C., representing a superheat of about 250° C. Gas atomization of the melt was carried out using nitrogen. The rapidly solidified (RS) powder was consolidated into a bar by hot extrusion, involving an extrusion ratio of 10 to 1. Ingot material also was extruded for comparison with the consolidated powder which exhibited full densification with no evidence of porosity or prior particle boundaries. Tensile properties, obtained on testing at room temperature, 600° C. and 800° C., are shown in Table 4.

TABLE 4

| Alloy | Heat Treatment | Test Temp., ° C. | Ductility, % Stress, Yield | MPa Ultimate | Total Elong. | Red. Area |
|---|---|---|---|---|---|---|
| ABD4-RS[a] | 1200° C., 1 hour | 24 | 721 | 1135 | 44 | 54 |
| ABD4-CPC[b] | 1200° C., 1 hour | 24 | 425 | 629 | 11 | 7 |

TABLE 4-continued

| Alloy | Heat Treatment | Test Temp., ° C. | Ductility, % Stress, Yield | MPa Ultimate | Total Elong. | Red. Area |
|---|---|---|---|---|---|---|
| ABD4-RS | 1200° C., 1 hour | 600 | 454 | 807 | 41 | 49 |
| ABD4-CPC | 1200° C., 1 hour | 600 | 347 | 525 | 12 | 4 |
| ABD4-RS | 1200° C., 1 hour | 800 | 387 | 475 | 22 | 19 |
| ABD4-CPC | 1200° C. 1 hour | 800 | 247 | 317 | 34 | 34 |

[a]Rapidly solidified alloy, by gas atomization.
[b]Conventionally processed alloy, by ingot metallurgy.

These results clearly show the superiority in strength of the RS-processed alloy as compared to the same alloy conventionally processed. Also, strengthening is accompanied by a high degree of ductility; only the alloy heat treated at 800° C. showed a lower ductility than the conventionally processed alloy, and in that case, the retained ductility was good.

The ABD4 alloy, produced in accordance with the invention, was compared to conventionally processed Alloy 654SMO, a relatively new austenitic stainless steel comprising 22Ni-24Cr-7.3Mo-3Mn-0.02C, together with about 0.4 to 0.5 N and 0.4 Cu, and incidental steelmaking impurities. The results are shown in Table 5.

TABLE 5

| Alloy | Stress, MPa Yield | Ultimate | Percent Total Elong. | Red. in Area |
|---|---|---|---|---|
| 654SMO (CPC)[a] | 430 | 750 | 40 | — |
| ABD4 (CPC) | 425 | 629 | 11 | 7 |
| ABD4 (RSP)[b] | 721 | 1135 | 44 | 54 |

[a]Conventional Processing, by ingot metallurgy.
[b]Rapid Solidification Processing, according to this invention.

As seen in Table 5, the ABD4 (RSP) alloy far exceeded in strength the same, conventionally processed, alloy as well as conventionally processed Alloy 654SMO, and had greater ductility than either of the comparison, conventionally processed alloys. Creep tests on the ABD4 alloy, at $600^0$L and 400 and 500 Mpa stress levels, have shown rupture times of >5900 and 1708 hours, respectively. The test at 400 MPA is still in progress and further-extended rupture time is expected.

To illustrate the good corrosion resistance of the alloys of the invention, the ABD4 alloy, pre-solution annealed and solution annealed (at 1200° C. for 1 hour) condition (before and after dissolution of the sigma phase), was tested against some well-known commercial corrosion-resistant alloys, i.e. C22 (a Hasteloy) having a composition, by wt. %, of 3Fe-22Cr-13Mo-0.3V-3W-2.5Co-0.5Mn-0.02C-balance Ni, and Alloy 625 having a composition, by wt. %, of 3Fe-22Cr-9Mo-3.4Nb-0.05Mn-0.06C-balance Ni. Both reference alloys, denoted, respectively, as IM C22 and IM 625, were produced by conventional ingot metallurgy. These alloys were subjected to electrochemical polarization tests in chloride solution (HCl and NaCl). As shown in FIG. 12, the behavior of the alloys indicates that they are very corrosion-resistant. The further to the left in which an alloy appears in FIG. 12, the more corrosion-resistant the alloy. For best corrosion resistance, the ABD4 alloy should be solution annealed. In that condition, the ABD4 alloy shows comparable behavior to the more expensive, nickel-base alloy C22, and it is significantly better than the nickel-base alloy 625.

The austenitic stainless steels of the invention may have compositions within the ranges of elements as shown in Table 6.

TABLE 6

| Element | Amount, wt. % Broad | Preferred |
|---|---|---|
| Cr | 15 to 30 | 15 to 25 |
| Ni | 8 to 25 | 18 to 25 |
| Mo | 0.05 to 8 | 2 to 8 |
| Mn | 2.0 max. | 2 max. |
| Si | 1.0 max. | 1 max. |
| V | 0.05 to 3.0 | 0.5 to 3 |
| Al | 0.05 max. | 0.005 to 0.05 |
| Ti | 0.05 max. | 0.05 max. |
| Nb | 1.0 max. | 0.5 max. |
| P | less than 0.05 | less than 0.05 |
| S | less than 0.05 | less than 0.05 |
| O | 0.005 to 0.1 | 0.005 to 0.1 |
| N | 0.01 to 0.5 | 0.01 to 0.5 |
| C | 0.01 to 0.08 | 0.01 to 0.08 |
| Fe | balance. | balance. |

The structure of austenitic stainless steels is the same as nickel-base alloys and, in principle, nickel-base alloys respond similarly to the austenitic stainless steels using oxygen to form the nm-hollow oxides, provided that vanadium (with or without Nb) is present in the alloy and the amounts of the very high energy oxide formers such as Al and Ti are minimal.

The nickel-base alloys of the invention may have compositions within the range of elements shown in table 7.

TABLE 7

| Element | Amount, wt. % |
|---|---|
| Fe | up to 20 |
| Cr | 10 to 30 |
| Mo | 2 to 12 |
| Nb | 6 max. |
| V | 0.05 to 3.0<br>preferably 0.10 to 3.0 |
| Mn | 0.8 max. |
| Si | 0.5 max. |
| W | 3.0 max. |
| Al | 0.05 max.<br>preferably less than 0.01 |
| Ti | 0.05 max.<br>preferably less than 0.01 |
| P | less than 0.05 |
| S | less than 0.05 |
| C | 0.01 to 0.08 |
| N | less than 0.2 |
| O | 0.005 to 0.1 |
| Ni | balance. |

For purposes of achieving the additional benefit of grain boundary pinning by solid oxides, especially aluminum oxides, and the consequent grain refining and stabilisation, at least an effective amount of aluminum, e.g. about 0.005 wt. %, is needed, and/or effective amounts for this purpose of Si, Mn, Nb, and/or Ti should be present.

As an adjunct to our research on nickel-base alloys, we have found that, contrary to common practice, nitrogen can be used for atomization instead of the other, more expensive inert gases, argon or helium.

As described above, the atomized particles can form a powder which is then consolidated, as by hot extrusion, or the atomized particles can be deposited directly, e.g., in the form of a solid bar, on a suitable substrate.

What is claimed is:

1. A method of producing austenitic stainless steels and nickel-base alloys of enhanced strength and retained ductility, comprising, under cover of an inert gas, forming an alloy melt containing from about 0.05 to about 3.0 wt. % vanadium, from about 0.01 to about 0.08 wt. % carbon, from about 0.01 to about 0.5 wt. % nitrogen, about 0.05 max. wt. % each of aluminum and titanium, introducing sufficient oxygen into the atmosphere over the melt to provide about 0.005 to about 0.1 wt. % dissociated oxygen in the melt, and atomizing the melt to form a solid granular product containing a plurality of approximately 7–10 nanometer diameter hollow oxides inside the alloy grains.

2. A method according to claim 1, further comprising subjecting the product to an aging heat treatment and thereby forming strengthening carbide and nitride precipitates nucleated on the hollow oxides inside the alloy grains.

3. A method according to claim 2, further comprising providing in the melt from an effective amount to about 0.05 wt. % of aluminum, and the product contains a plurality of solid oxides comprising aluminum oxide precipitated on the alloy grain boundaries and serving to pin the grain boundaries to provide a temperature-stable, fine grain structure which further strengthens the alloy.

4. A method according to claim 3, wherein the average grain size is from about 0.007 to about 0.010 mm after heat treatment of the alloy for 1 hour at a temperature from 1000° C. to 1200° C.

5. A method according to one of claims 1–4, wherein the product contains nitrogen in solid solution serving to still further strengthen the alloy.

6. Austenitic strainless steels and nickel-base alloys made by the process of one of claims 1–5.

7. Austenitic stainless steel and nickel-base alloys of enhanced strength and retained ductility comprising a consolidated body of alloy particles atomized from a melt under an inert gas atmosphere and containing from about 0.05 to about 3.0 wt. % vanadium, from about 0.01 to about 0.08 wt. % carbon, from about 0.01 to about 0.5 wt. % nitrogen, from about 0.005 to about 0.1 oxygen, and about 0.05 max. wt. % each of aluminum and titanium, wherein the oxygen predominantly is present in the form of intragranular hollow oxides.

8. An alloy according to claim 7 containing precipitated vanadium carbides and nitrides nucleated on the hollow oxides within the alloy grains and thereby strengthening the alloy.

9. An alloy according to claim 8, wherein at least a portion of the nitrogen is in solid solution in the alloy, providing further strengthening of the alloy.

10. An alloy according to claim 9, wherein aluminum is present in an amount at least effective to form solid oxides precipitated along and pinning grain boundaries of the alloy providing a fine, temperature-stable grain structure and still further strengthening the alloy.

11. An alloy according to claim 10, wherein the alloy grains have an average diameter from about 0.007 to about 0.010 mm. after heat treatment for 1 hour at a temperature from 1000° C. to 1200° C.

12. Austenitic stainless steel and nickel-base alloys comprising about 0.05 to 3.0 wt. % vanadium, about 0.005 to 0.1 wt. % oxygen, and about 0.01 to 0.08 wt. % carbon, strengthened by intragranular precipitation of vanadium carbides and nitrides nucleated on approximately 7–10 nanometer hollow oxides resident within the alloy grains.

13. Austenitic stainless steel and nickel-base alloys strengthened by a combination of (a) intragranular precipitation of carbides and nitrides nucleated on approximately 7–10 nanometer hollow oxides resident within the alloy grains, (b) nitrogen solid solution strengthening, and (c) grain boundary pinning by solid oxides comprising aluminum oxides precipitated along the grain boundaries.

14. An austenitic stainless steel alloy of enhanced strength and retained ductility comprising solidified and consolidated particles atomized from a melt under an inert gas atmosphere and consisting essentially of, in wt. %:

| | |
|---|---|
| chromium | 15 to 30 |
| nickel | 8 to 25 |
| vanadium | 0.05 to 3.0 |
| niobium | 1.0 max. |
| manganese | 2.0 max. |
| silicon | 1.0 max. |
| molybdenum | 0.05 to 8.0 |
| aluminum | 0.05 max. |
| titanium | 0.05 max. |
| oxygen | 0.005 to 0.1 |
| nitrogen | 0.01 to 0.5 |
| carbon | 0.01 to 0.08 |
| iron | balance, except for incidental steelmaking impurities. |

15. An alloy according to claim 14, wherein strengthening of the alloy is derived in part from precipitation, after aging of the alloy, of carbides and nitrides nucleated by hollow oxides inside the alloy grains.

16. An alloy according to claim 15, wherein the hollow oxides have an average diameter of about 7–10 nanometers.

17. An alloy according to claim 16, wherein the alloy contains an amount of aluminum effective to form approximately 50 nanometer solid aluminum oxides precipitated along and pinning alloy grain boundaries and which provide temperature-stable fine alloy grains which further strengthen the alloy.

18. An alloy according to claim 17, wherein at least a part of the nitrogen is in solid solution in the alloy, still further strengthening the alloy.

19. An austenitic stainless steel alloy of enhanced strength and retained ductility comprising solidified and consolidated metal particles atomized from a melt under an inert gas atmosphere and consisting essentially of, in wt. %:

| | |
|---|---|
| chromium | 15 to 25 |
| nickel | 18 to 25 |
| molybdenum | 2 to 8 |
| manganese | 2.0 max. |
| silicon | 1.0 max. |
| vanadium | 0.5 to 3.0 |
| aluminum | 0.05 max. |
| titanium | 0.05 max. |
| niobium | 0.5 max. |
| phosphorous | less than 0.05 |
| sulfur | less than 0.05 |
| oxygen | 0.005 to 0.1 |
| nitrogen | 0.01 to 0.5 |
| carbon | 0.01 to 0.08 |
| iron | balance. |

20. An alloy according to claim 19, wherein the oxygen in the solidified metal is present predominantly in the form of hollow oxides inside grains of the metal.

21. An alloy according to claim 20, wherein the hollow oxides have an average size of about 7–10 nanometers.

22. An alloy according to claim 20, wherein strengthening of the alloy is derived in part from precipitation, after aging of the alloy, of carbides and nitrides nucleated by the hollow oxides.

23. An alloy according to claim 22, wherein aluminum is present in an amount at least effective to form solid aluminum oxides precipitated along and pinning alloy grain boundaries thereby providing a temperature-stable and fine grain structure further strengthening the alloy.

24. An alloy according to claim 23, wherein at least a part of the nitrogen is present in solid solution and still further strengthening the alloy.

25. An austenitic stainless steel alloy of enhanced strength with retained ductility, comprising solidified and consolidated metal particles atomized from a melt under an inert gas atmosphere and consisting essentially of, in wt. %,:

| | |
|---|---|
| chromium | 16 to 18 |
| nickel | 10 to 12 |
| molybdenum | 2 to 3 |
| manganese | 2.0 max. |
| silicon | 1.0 max. |
| vanadium | 0.5 to 1.0 |
| aluminum | 0.05 max. |
| titanium | 0.05 max. |
| niobium | 0.5 max. |
| oxygen | 0.005 to 0.1 |
| nitrogen | 0.01 to 0.5 |
| carbon | 0.01 to 0.08 |
| iron | balance, except for incidental steelmaking impurities. |

26. An alloy according to claim 25, wherein the oxygen in the solidified metal is present predominantly in the form of hollow oxides inside grains of the metal and, after aging heat treatment of the alloy, nucleating vanadium carbides and nitrides which strengthen the alloy, a minor portion of the oxygen is present in the form of solid oxides precipitated along and pinning alloy grain boundaries thereby providing fine, temperature-stable grains further strengthening the alloy, and at least a portion of the nitrogen is present in solid solution still further strengthening the alloy.

27. A corrosion-resistant austenitic stainless steel alloy of enhanced strength with retained ductility, comprising solidified and consolidated metal particles atomized from a melt under an inert gas atmosphere and consisting essentially of, in wt. %:

| | |
|---|---|
| chromium | 24 to 26 |
| nickel | 18 to 22 |
| molybdenum | 6 to 12 |
| manganese | 2.0 max. |
| silicon | 1.0 max. |
| vanadium | 0.5 to 1.0 |
| aluminum | 0.05 max. |
| titanium | 0.05 max. |
| niobium | 0.5 max. |
| oxygen | 0.005 to 0.1 |
| nitrogen | 0.01 to 0.5 |
| carbon | 0.01 to 0.08 |
| iron | balance, except for incidental steelmaking impurities. |

28. An alloy according to claim 27, wherein the oxygen in the solidified metal is present predominantly in the form of hollow oxides inside grains of the metal and, after aging heat treatment of the alloy, nucleating vanadium carbides and nitrides which strengthen the alloy, a minor portion of the oxygen is present in the form of solid oxides precipitated along and pinning alloy grain boundaries thereby providing fine, temperature-stable grains further strengthening the alloy, and at least a portion of the nitrogen is present in solid solution still further strengthening the alloy.

29. An austenitic stainless steel alloy of enhanced strength comprising solidified and consolidated metal particles atomized from a melt under an inert gas atmosphere and consisting essentially of, in wt. %:

| | |
|---|---|
| chromium | 18 to 20 |
| nickel | 8 to 10 |
| manganese | 2.0 max. |
| silicon | 1.0 max. |
| vanadium | 0.1 to 3.0 |
| aluminum | 0.05 max. |
| titanium | 0.05 max. |
| niobium | 0.5 max |
| oxygen | 0.005 to 0.1 |
| nitrogen | 0.01 to 0.5 |
| carbon | 0.01 to 0.08 |
| iron | balance, except for incidental, steelmaking impurities. |

and wherein the oxygen is present predominantly in the form of approximately 7–10 nm hollow oxides inside the alloy grains and, after aging of the alloy, nucleating vanadium carbides and nitrides which strengthen the alloy.

30. An alloy according to claim 29, wherein the alloy contains at least an effective amount of aluminum to form solid aluminum oxides precipitated along and pinning alloy grain boundaries to provide fine and temperature-stable grains thereby further strengthening the alloy.

31. An alloy according to claim 30, wherein at least a portion of the nitrogen is in solid solution, thereby still further strengthening the alloy.

32. A nickel-base alloy of enhanced strength and retained ductility comprising solidified and consolidated metal particles atomized from a melt under an inert gas atmosphere and consisting essentially of, in wt. %:

| | |
|---|---|
| iron | up to 20 |
| chromium | 10 to 30 |
| molybdenum | 2 to 12 |
| niobium | 6 max. |
| vanadium | 0.05 to 3.0 |
| manganese | 0.8 max. |
| silicon | 0.5 max. |
| tungsten | 3.0 max. |
| aluminum | 0.05 max. |
| titanium | 0.05 max. |
| phosphorus | 0.05 max. |
| sulfur | 0.05 max. |
| carbon | 0.01 to 0.08 |
| nitrogen | less than 0.2 |
| oxygen | 0.005 to 0.1 |
| nickel | balance, |

wherein the oxygen predominantly is present in the form of approximately 7–10 nanometer hollow oxides inside grain boundaries of the alloy, and wherein, after aging heat treatment, the alloy is strengthened by precipitation of carbides and nitrides nucleated on the hollow oxides.

33. An alloy according to claim 32, wherein a minor portion of the oxygen is present in the form of approximately 50 nanometer solid oxide particles precipitated along and pinning grain boundaries to provide temperature-stable fine grains further strengthening the alloy, and wherein aluminum is present in an amount at least sufficient to form aluminum oxide in the form of said solid oxide particles.

34. An alloy according to one of claims 32 and 33, wherein at least a portion of the nitrogen is present in solid solution in the alloy, thereby still further strengthening the alloy.

* * * * *